US005383802A

United States Patent [19]

Nicholson

[11] Patent Number: 5,383,802

[45] Date of Patent: Jan. 24, 1995

[54] PROPULSION SYSTEM

[75] Inventor: Hugh B. Nicholson, Tallahassee, Fla.

[73] Assignee: Maelstrom, Inc., Tallahassee, Fla.

[21] Appl. No.: 153,085

[22] Filed: Nov. 17, 1993

[51] Int. Cl.[6] ..... B63H 11/00

[52] U.S. Cl. ..... 440/38

[58] Field of Search ..... 416/176, 177, 90 A, 416/92; 415/71, 72; 440/38, 47, 48; 60/221

[56] References Cited

U.S. PATENT DOCUMENTS

| | | | |
|---|---|---|---|
| 1,326,730 | 12/1919 | Helguera . | |
| 2,984,189 | 5/1961 | Jekat | 416/177 |
| 2,997,015 | 8/1961 | Richter | 440/38 |
| 3,011,561 | 12/1961 | Wagener | 440/38 |
| 3,233,573 | 2/1966 | Hamilton | 440/38 |
| 3,286,641 | 11/1966 | Delao et al. | 440/38 |
| 3,482,402 | 12/1969 | Anthoney | 60/221 |
| 3,512,762 | 5/1970 | Umbricht | 60/221 |
| 3,785,327 | 1/1974 | Smith | 60/221 |
| 3,804,553 | 4/1974 | Hickey | 416/177 |
| 3,977,353 | 8/1976 | Toyama | 440/38 |
| 4,182,118 | 1/1980 | Chronic | 60/221 |
| 4,389,197 | 6/1983 | Ballantine | 440/38 |
| 4,696,651 | 9/1987 | Wagemann | 416/90 A |
| 4,838,819 | 6/1989 | Todorovic | 440/47 |
| 4,931,026 | 6/1990 | Woodland | 440/138 |
| 5,181,868 | 1/1993 | Gabriel | 440/38 |
| 5,222,863 | 6/1993 | Jones | 415/199.5 |

FOREIGN PATENT DOCUMENTS 8201160 3/1982 Netherlands .

*Primary Examiner*—Edwin L. Swinehart

*Attorney, Agent, or Firm*—Oblon, Spivak, McClelland, Maier, & Neustadt

[57] ABSTRACT

The present invention relates to a fluid propulsion system having an outer shell which provides bearing support, ducting and streamlining for a hollow inner propulsion rotor. The rotor includes vanes having a plurality of blade sections which are supported and evenly spaced on an inner surface of the rotor parallel to the rotational axis. Rotation of the rotor with respect to the outer shell draws air/gas into the fluid medium via a venturi effect. The blade sections are designed so as to maintain contact with the fluid molecules passing through the fluid propulsion system and thus is able to provide additional energy to the molecules which are already placed in motion by the blade sections.

15 Claims, 8 Drawing Sheets

PROPULSION SYSTEM

BACKGROUND OF THE INVENTION

1. Field of the Invention

The present invention relates to a fluid propulsion system which comprises an outer shell which provides bearing support, ducting and streamlining for a hollow inner propulsion tubular member or rotor. The rotor comprises vane means attached on an interior surface of the rotor which includes blades that extend in a direction toward the rotational axis such that rotation of the tubular member and the vane means attached thereon draws air and fluid into the tubular member to accelerate the fluid flow through the tubular member.

2. Discussion of the Related Art

In conventional propulsion systems, the propellers perform the work required to accelerate a large number of molecules to a relatively low velocity and accordingly are unable to operate further on the molecules to follow up on the work that was expended to overcome the initial inertia. This is due to the fact that a fluid molecule at rest tends to remain at rest and thus once placed in motion, a relatively smaller amount of energy is required to further accelerate it. Additionally, the parts in conventional propulsion systems are easily damaged by foreign objects and unprotected screw-type propulsion systems pose a danger to divers and other living systems which pass in the vicinity of the propulsion system.

SUMMARY OF THE INVENTION

Accordingly, an object of the present invention is to provide for a novel propulsion system which gains thrust by providing a larger acceleration to a smaller mass of fluid as compared to conventional propellers. The design of the propulsion system of the present invention permits the propellers to maintain contact with the fluid molecules for a longer period of time and is thus able to provide additional energy to molecules already placed in motion. In this way, the initial work required to overcome the resting inertia of the fluid molecules is a smaller percentage of the overall energy expended, and accordingly, efficiency is increased.

A further object of the present invention is to provide for a propulsion system which uses air to reduce stress loads and cavitation and at the same time increases thrust. It is known that air can be introduced to reduce stress, however, in the present invention air is sucked into the system to increase thrust.

A further object of the present invention is to provide for a novel propulsion system which is compact, provides a vectored thrust and is easily protected from damage by foreign objects.

The present invention further provides for a propulsion system which can operate efficiently at high RPM while reducing the complexity and weight of transition gearing from the power plant to the propulsion system. This translates into a decreased system weight, increased efficiency of the total engine and drive system and a lighter power plant.

In the present invention, centrifugal force created by the rotating tubular member or rotor and vanes is/are capable of displacing most of any organic matter into the center of the system for ejecting to the rear without interrupting the forward speed or increasing potential damage to internal parts. By providing the vanes in a manner in which they extend from the tubular member in a direction toward the rotational axis of the system, there is no need for having a central shaft or hub. The absence of a center shaft or hub protects the system from fouling nets and lines that commonly entangle propellers and shafts in shallow waters and in commercial fishing grounds. The minimization of danger to divers or living systems in the vicinity of the propulsion system makes the propulsion system adaptable for use in water rescues and other types of operations in which divers are positioned next to the propulsion system.

Accordingly, the present invention provides for a propulsion system which comprises a cylindrical support member and a tubular rotatable member rotatably mounted within the support member and adapted to permit a fluid flow therethrough. The tubular member defines first, second and third sections which extend along a longitudinal direction of the tubular member. The first section of the tubular member extends substantially parallel to a rotational axis of the tubular member or slightly tapers inwardly in a direction toward the rotational axis of the tubular member to restrict the fluid flow therethrough. If the first section tapers inwardly, the second section can begin at a point along the tubular member where further restriction by the tapering first section would inhibit the fluid flow. The second section extends radially outwardly from the first section in a direction away from the rotational axis and the third section extends in a direction which is substantially parallel to the rotational axis. The propulsion system further comprises vane means attached on an interior surface of the tubular member and comprising blades which extend in a direction toward the rotational axis such that rotation of the tubular member and the vane means attached thereon draws air and fluid into the tubular member to accelerate the fluid flow through the tubular member.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
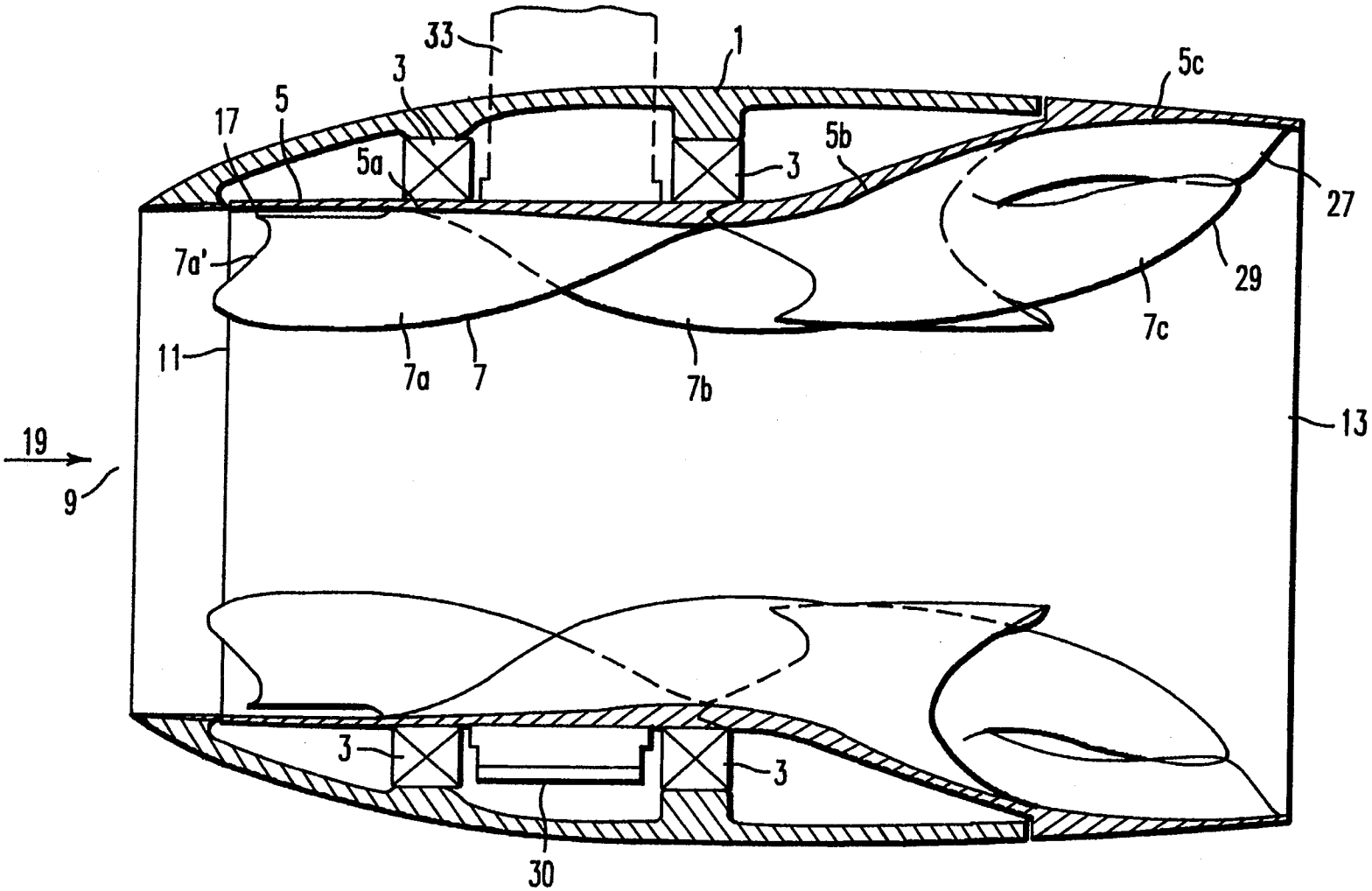
FIG. 1 illustrates a cross-sectional longitudinal view of the propulsion system of the present invention including the support member, rotor and vanes.
Figure 8:
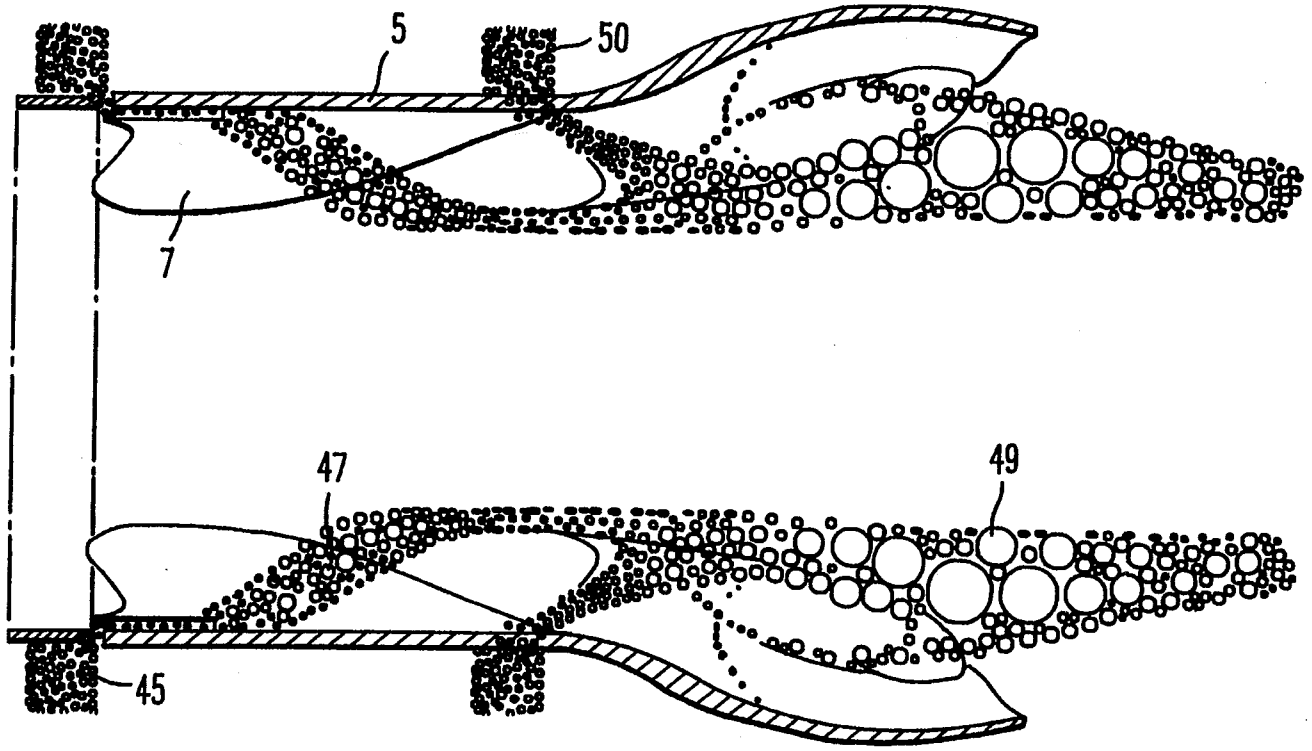
FIG. 8 schematically shows the rotor and vanes as well as gas/air-flow therethrough.

Referring now to the drawings, wherein like reference numerals designate identical or corresponding parts throughout the several views, and more particularly to FIG. 1 thereof, FIG. 1 is a cross-sectional longitudinal view of the propulsion system of the present invention. As illustrated in FIG. 1, the propulsion system comprises an outer shell or member 1 having bearings 3 for supporting an inner propulsion tube or rotor 5. As noted above, the outer shell 1 provides bearing support for the inner propulsion tube 5 and further provides ducting and streamlining for the inner propulsion tube or rotor 5. The rotor 5 is hollow with vanes 7 extending from an interior surface of the rotor 5 to the rotational axis 9 of the rotor 5. The rotor 5 defines first 5*a*, second 5*b* and third 5*c* sections which extend along a longitudinal direction of the rotor. The first section 5*a* of the rotor 5 is slightly tapered to provide a venturi effect so as to draw air into a fluid medium passing through the rotor 5. FIG. 8 illustrates a rotor configuration in which the first section 5*a* is substantially parallel to the rotational axis of the rotor. In the case where the first section 5*a* inwardly tapers, the second section 5*b* may begin at a point along the tubular member where further restriction by the tapering first section 5*a* would inhibit the fluid flow, however, the point at which the second section 5*b* begins is not limited to this point and may depend on design considerations. The second section 5*b* extends outwardly to a third section 5*c* which gradually returns to a surface which is parallel to the axis of rotation 9 at the exit of the tubular member 5.

The vanes 7 which extend from the rotor 5 comprise blades which define first 7*a*, second 7*b* and third 7*c* blade sections. The vane shapes when viewed in cross-section from a point perpendicular to the rotor's rotational axis 9, define an archimedes screw, but change in angle of attack and loaded surface areas in proportions that roughly correspond to water speed and rotor diameter. The first, second and third blade sections 7*a*, 7*b*, 7*c* are evenly spaced around the circumference of the rotor 5. It is noted that the number of blade sections set forth in the present specification is for descriptive purposes and is not limited to three. The number of blade sections depends on design considerations and can be less than or more than three. Each set of blade sections 7*a*, 7*b*, 7*c* consists of individual vanes which are spaced parallel to the rotational axis 9 of the rotor and inwardly project from the rotor 5 toward the rotational axis 9, but do not reach the rotational axis 9. The first blade section 7*a* is located at the first section 5*a* of the rotor 5 and extends from an entrance 11 of the rotor 5 to the second section 5*b* of the rotor for driving air and fluid to the second blade section 7*b*. The second blade section 7*b* overlaps the first 7*a* and third 7*c* blade sections. The second blade section 7*b* extends from the first section 5*a* to the third section 5*c* of the rotor 5 while the third blade section 7*c* extends from the second section 5*b* to the third section 5*c* of the rotor 5 and extends substantially to an exit 13 of the rotor 5.

Figure 2B:
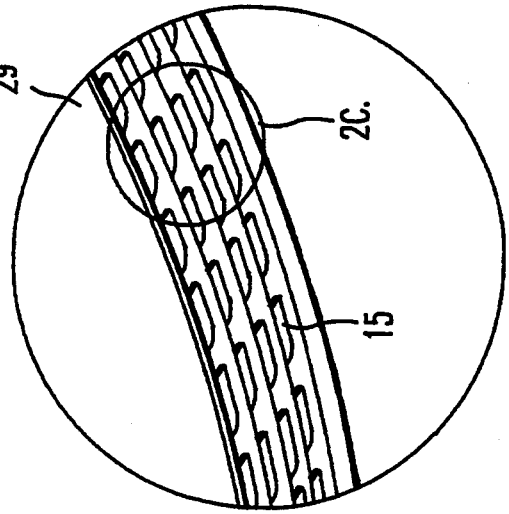
FIG. 2B is an enlarged section view of the circled portion in FIG. 2A.
Figure 2C:
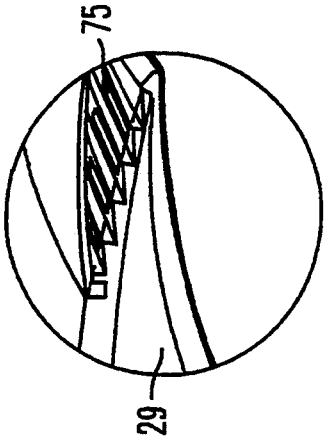
FIG. 2C is an enlarged section view of the circled portion in FIG. 2B in which an alternate embodiment of the ducts of FIG. 2B is illustrated.
Figure 2A:
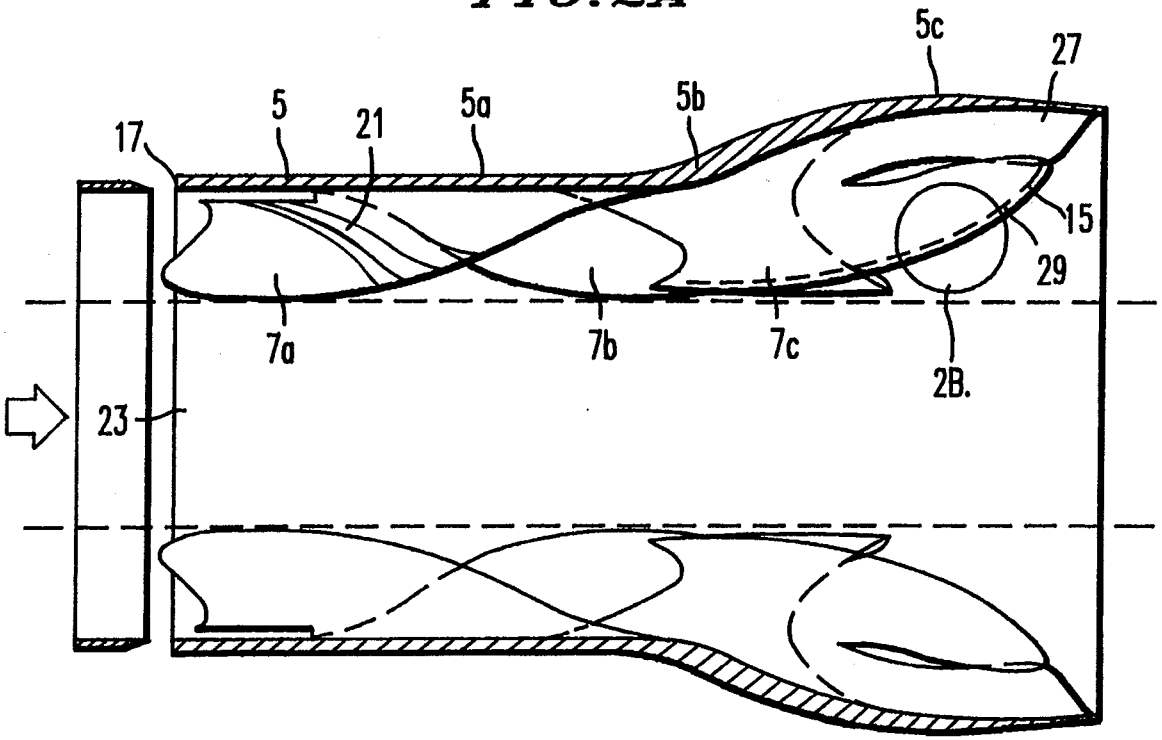
FIG. 2A is also a longitudinal cross-sectional view of the propulsion system illustrating slots and ducts on the vanes.
Figure 5:
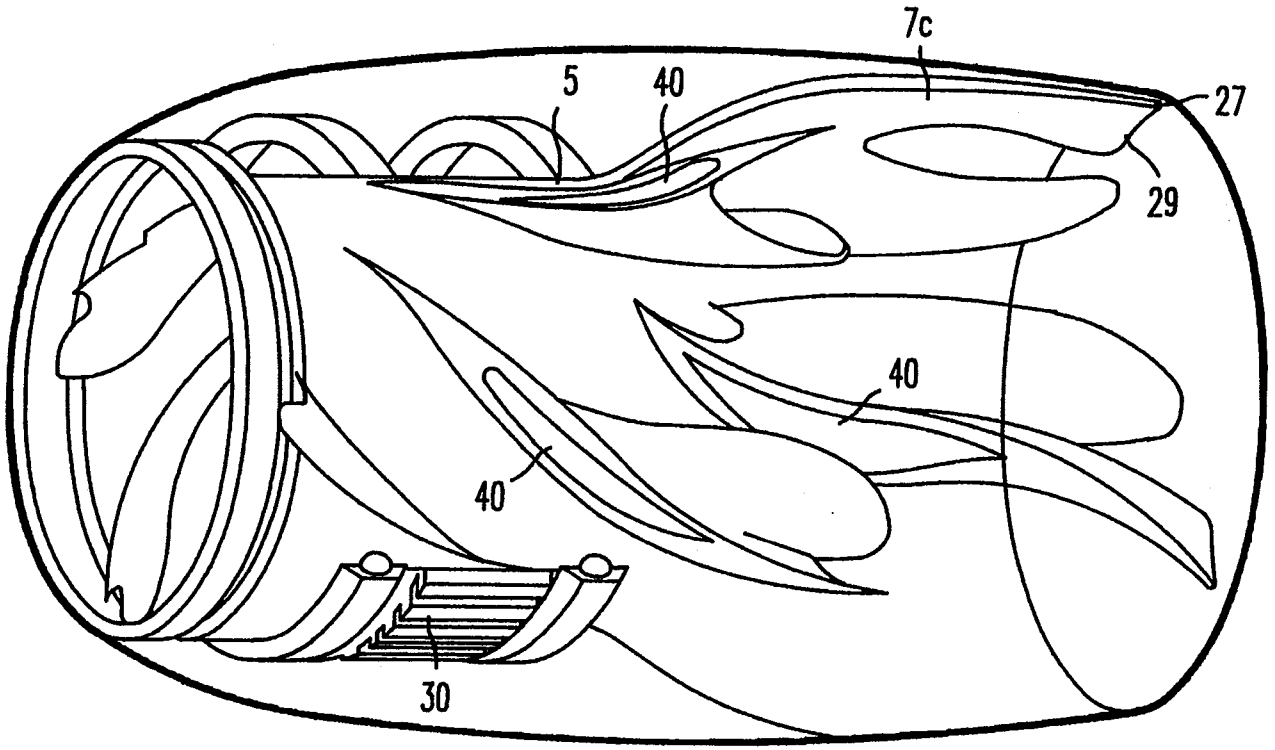
FIG. 5 is a perspective view of the overall propulsion system illustrating features of the vanes.
Figure 7:
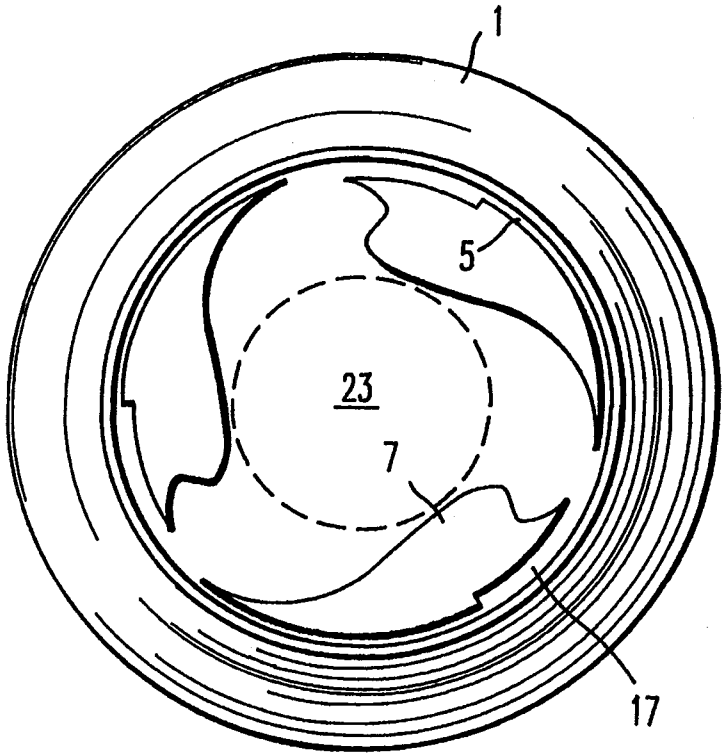
FIG.6 and 7 are respectively rear and front views of the propulsion system illustrated in FIG. 1.

It is noted that at least one of the second and third blade sections 7*b*, 7*c* may comprise ducts at 15 as illustrated in FIG. 2A and FIG. 2B which is an enlarged section of FIG. 2A illustrating the ducts 15, for allowing air at atmospheric pressure to be introduced into the last half of the blade length. As illustrated in FIG. 5, the second and third blade sections may be hollow and comprise channels 40 for fluid flow.

Referring now to the rotor or tubular member 5, as noted above and illustrated in the embodiment of FIG. 1, the first part 5*a* of the rotor may be slightly constricted and then at the second part 5*b* the rotor 5 flares outwardly to displace the volume created by the cross-section of the vanes 7 which would otherwise constrict flow. The blade sections 7*b*, 7*c* which are attached to the rear sections 5*b*, 5*c* of the rotor 5 serve as centrifugal impeller blades and accordingly represent a large aspect of applied rotational force of the device.

Regarding the first, second and third blade sections 7*a*, 7*b*, 7*c*, the first blade section 7*a* acts as, for example, a water impeller blade. The second and third blade sections 7*b*, 7*c* overlap each other and act in their leading surfaces as stators or guides for channeling the fluid flowing therethrough and in their aft sections the second and third blade sections 7*b*, 7*c* introduce and manipulate the air/gas flow therethrough.

The first, second and third blade sections 7*a*, 7*b*, 7*c* maintain contact with the fluid for a relatively long period of time and distance. The shape of the individual vanes 7 provide constant angles of attack with respect to the fluid molecules as they increase speed along the length of the rotor 5. This results in continued acceleration of the fluid over a longer distance. In this way, the work required to overcome the resting inertia of the fluid becomes a smaller percentage of the total work accomplished and efficiency is therefore increased.

Due to the shape of the rotor 5, air is introduced using venturi effects to occupy areas of low pressure that would normally cause cavitation downstream. At the point of cavitation, when collapse of the vapor bubble would ordinarily cause fluid molecules to break down, compressed air provides an accumulator action which maintains forward velocity and when allowed to expand further downstream, provides further acceleration to the fluid molecules. The efficiency of the blade sections 7*a*, 7*b*, 7*c* of the present invention is consistent with the laws of momentum. A molecule at rest tends to remain at rest and a relatively large amount of energy is required to induce the onset of motion. A conventional propeller expends a proportionally larger amount of energy in constant attack against inertially resistant static fluid molecules. The propulsion system of the present invention accelerates individual molecules by serially working on them and passing them from one blade section to a next blade section. Thus, a great deal more work can be expended on each molecule of the fluid element, and therefore, on the totality of the molecules passing through the propulsion system. Thus, the propulsion system continues to build upon the work it has already accomplished and accordingly provides for an increase in efficiency.

Figure 3:
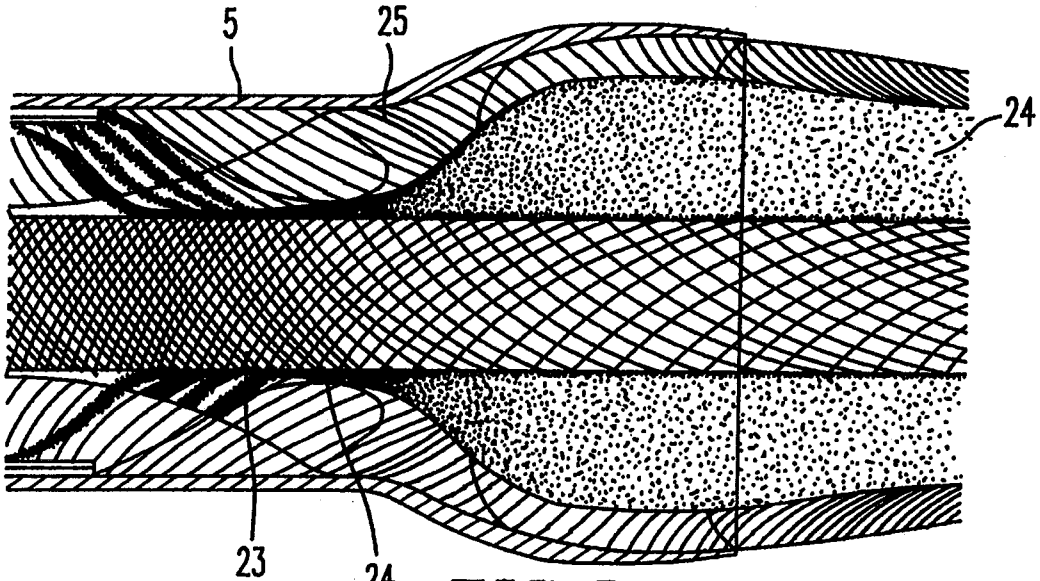

Referring now to the first blade section 7*a* of FIG. 1 and the fluid flow illustration of FIG. 8, it is noted that a first part 7*a*' of the first blade section 7*a* is spaced from the interior surface of the rotor 5 to provide for a slot or void 17 of undisturbed liquid between the rotor and the blade. During operation, water accelerated through the device produces a venturi effect at 45 in FIG. 8 which draws air/gas into this slotted area 17 where it accumulates to a certain discreet volume. The size of this area corresponds to a difference between a diameter increase of the wall of the rotor 5 in excess of the intake diameter. The front-projecting areas, with respect to a fluid flow direction 19, of the first blade section *7a* during rotation will begin to impart a spinning motion to the liquid. The area of the first blade section *7a* which is attached to the rotor begins to spin water against the walls of the rotor 5 and therefore increase pressure due to centrifugal force exerted against the inside walls of the rotor and forces air entrained against the walls of the rotor to seek areas of less pressure to produce a flow as illustrated by reference numeral 47 in FIG. 8. The trailing edge of the first blade section *7a*, with respect to the fluid flow direction 19, contains depressed areas or slots 21 (FIG. 2) that provide natural routing for the entrained air (flow 47, FIG. 8) to migrate from the walls of the rotor 5 along the slots 21 to the center of the rotor 5 to form a tube or sleeve 24 around a central tube of water 23 (FIGS. 3 and 4) which is not mechanically acted upon. The blade sections create a fast-moving outer ring of water 25 as further illustrated in FIG. 3. Reference numeral 24 in FIGS. 3 and 4 basically represents low pressure areas of air.

Thus, the propulsion system of the present invention enhances efficiency due to air inducted into the fluid by natural venturi effects. The design draws air into areas of low pressure 24 (FIG. 3) that would normally allow vapor bubbles to form. In addition, energy lost due to turbulence at apices and trailing edges of the blade sections is minimized by dropping or holding a stream of entrained air in close proximity to (or impinging upon) areas of predicted low pressures. The rotor wall constriction in the first section *5a* of the rotor 5 indirectly compresses air admitted to high stress areas, effectively pre-loading higher-pressure air into these regions. Consequently, potential vapor pockets either do not form or are filled with gas or air. In typical operation, a low pressure area implies the expansion of gas or air to fill the anticipated vacuum, and, because low pressure phenomena occur with steadily increasing frequency throughout the rear two thirds of the propulsion device, bubbles 49 (FIG. 8) tend to accumulate into even larger, stable, visible gas or air pockets that emerge from the device as a cloud of pea-size bubbles suspended between the fast-moving outer ring of water 25 (FIG. 3) driven by the blade sections *7a*, *7b*, *7c* and the slower moving inner core of water 23 that forms around the axis of rotation 9 of the propulsion device in the center area that is not disturbed by the vanes.

Figure 4:
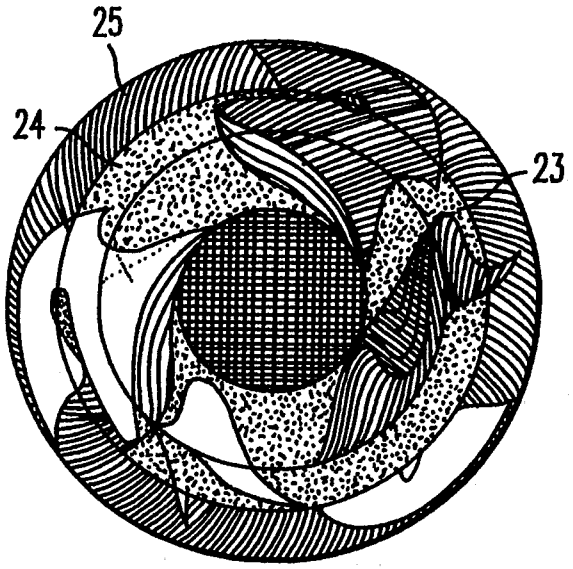
FIGS. 3 and 4 are respectively side and rear views of the propulsion system which schematically illustrates fluid flow through the system.

If observed from either end, the propulsion device of the present invention has a cross-section which resembles a doughnut as illustrated in FIG. 4. The outer mass is the area of water 25 which is driven by the blade sections *7a*, *7b*, *7c* and the hole is a tube of slower moving, quieter water 23. The boundary between these two fluid streams is surrounded by the bubbles described which act as air bearings between the two so as to largely cancel drag effects of the inner core of smoother flowing water 23. As the fluid passes through the system, it reaches an area in which vapor bubbles would typically implode to cause cavitation. Since the vapor pockets are now filled with air, they do not collapse. The higher pressures that are working to collapse the bubbles simply compress the trapped air. The work of compression is recovered later in the process in areas of lower pressure where the bubbles act as soft-sided-air-accumulators expanding, and, while expanding, imparting additional acceleration to the fluid medium.

Regarding the second blade section *7b*, this section represents a transition from water driving propellers to centrifugal pump-effect blade sections of the third set *7c*. The second and third blade sections *7b*, *7c* are designed to guide and straighten a highly rotational flow created by the first blade section *7a* and also to impart some additional thrust. The second and third blade sections *7b*, *7c* further define the above-noted boundary which creates the air bearing between the flows of active water and quiet water 25, 23. The second and third blade sections *7b*, *7c* further admit additional gas-/air illustrated by reference numeral 50 in FIG. 8 to augment the sleeve at the interior apices of the blade sections. They further initiate some molecular fragmentation of water at very high speeds (gasify) and begin definition of a high-vacuum area between the divergent streams of water/gas.

As illustrated in the drawings, the second blade section *7b* overlaps the first and third blade sections *7a*, *7c* and spans the area from the smallest constriction to an area intruding into the large flared area of the rotor 5. At least one of the second and third blade sections *7b*, *7c* can be hollow with ducts 15 (FIG. 2) on the back of the blade sections which allow passage of gas/air admitted through rotor walls and channels 40 (FIG. 5).

Figure 6:
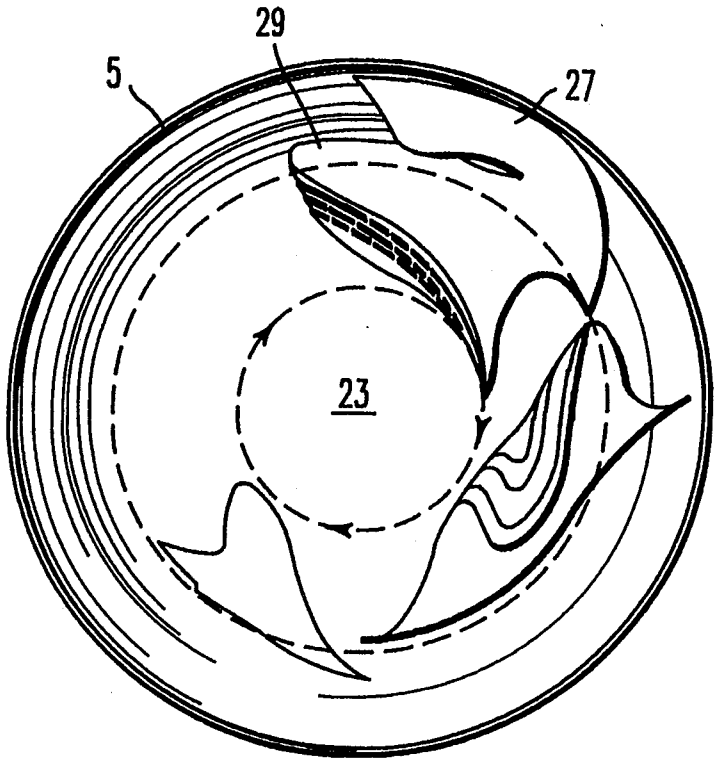

Regarding the third blade section *7c*, this third blade section *7c* consists of two distinct lobes 27, 29 (FIGS. 1 and 6), one of which begins at the point where the rotor walls begin to flare out to the largest diameter. The principal drive aspect of the first lobe 27 is a blade element which follows the rotor walls and decreases in angle of attack until, at the exit of the device, the blade angle is nearly parallel to the axis of rotation 9. This first lobe is mounted nearly at right angles to the rotor walls and utilizes centrifugal forces to propel liquid backwards. This first lobe is solid and has a thin cross-section. The other lobe 29 is flat and hollow and has a rounded projection into the central area defining the circumference of the quiet core or tube of water/liquid 23 on one side, and a layer of wall-hugging centrifugal liquid on the other side. This other lobe 29 successively sweeps the areas defined by the edges of the first lobes and captures and straightens vortices at these high-pressure apices. Also, through the ducts 15 in the trailing and rear surfaces of this hollow lobe 29, gas is admitted to fill cavitational voids. It is further recognized that the hollow lobe 29 can be comprised of a porous material or any material which is capable of admitting gas/air.

At a point where the walls of the rotor flare outward, the original venturi-admitted gas at 45 in FIG. 8 is in a well-defined sleeve or air bearing which effectively washes cavitation prone surfaces and is available to fill such voids at a variety of speeds. This sleeve, at expansion point, acts as a low-pressure precursor to a larger volume of air/gas subsequently admitted through the ducts 15 (FIGS. 2A and 2B) of the hollow lobe which have ports impinging upon the sleeve area. As the rotor width expands, the high speed water, facilitated by the air stream, represents enough cumulative mass that the quiet stream and a centrifugally impelled stream form their own distinct walls on the interior of the rotor separated by a region of tremendous potential vacuum that sucks in available air/gas through the ducts on the blade sections and from the entrained sleeve. Thus, all cumulative mechanical effects are allowed free opportunity to build upon each other and contribute to the forward thrust.

In further embodiments of the propulsion system of the present invention, it is noted that the second and third blade sections can include movable flaps 75 on the ducts of the second and third blade sections as illustrated in FIG. 2C. The flaps 75 may be made of a flexible material. At speed, low pressure along the surfaces of the second and third blade sections would allow the movable flaps 75 to open only at reduced pressure to ensure that only gas is admitted when necessary.

It is a further feature of the propulsion system of the present invention that materials having flexibility can be used for the blade sections.

Figure 9:
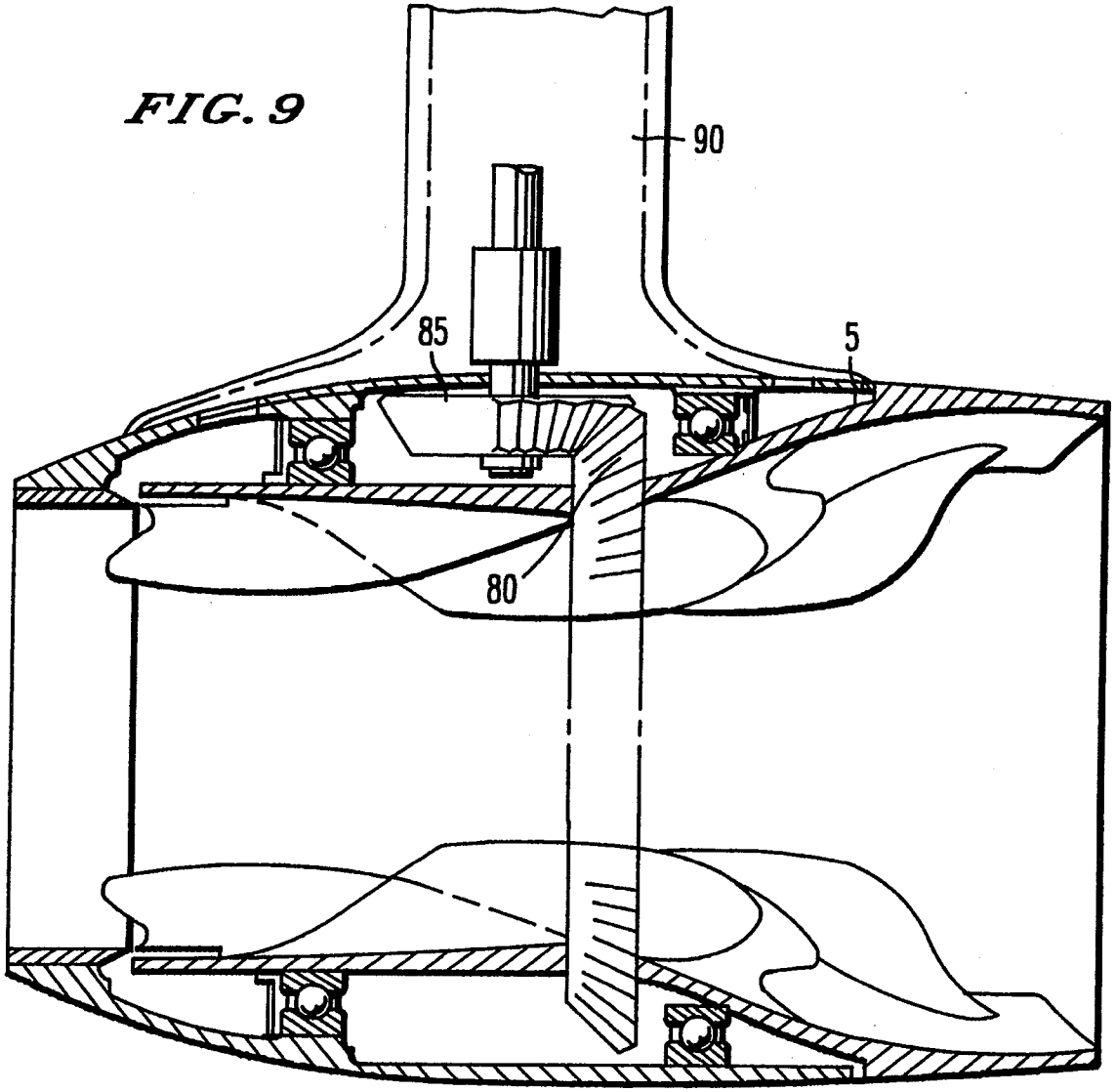
FIG. 9 schematically illustrates the propulsion system and a drive mechanism.
Figure 10A:
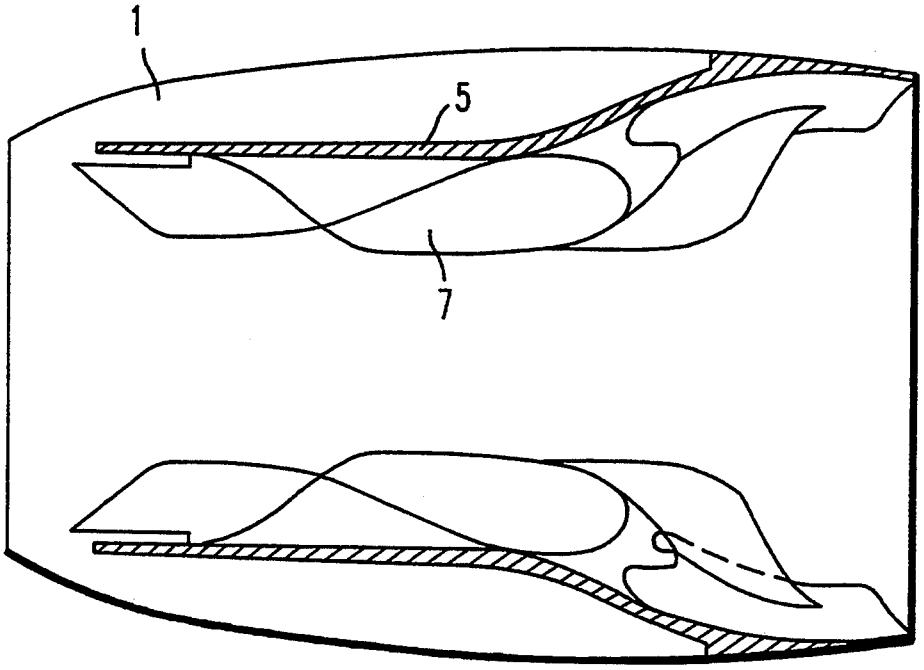
FIG. 10 schematically illustrates the propulsion system of the present invention utilized in an outboard motor arrangement.
Figure 10B:
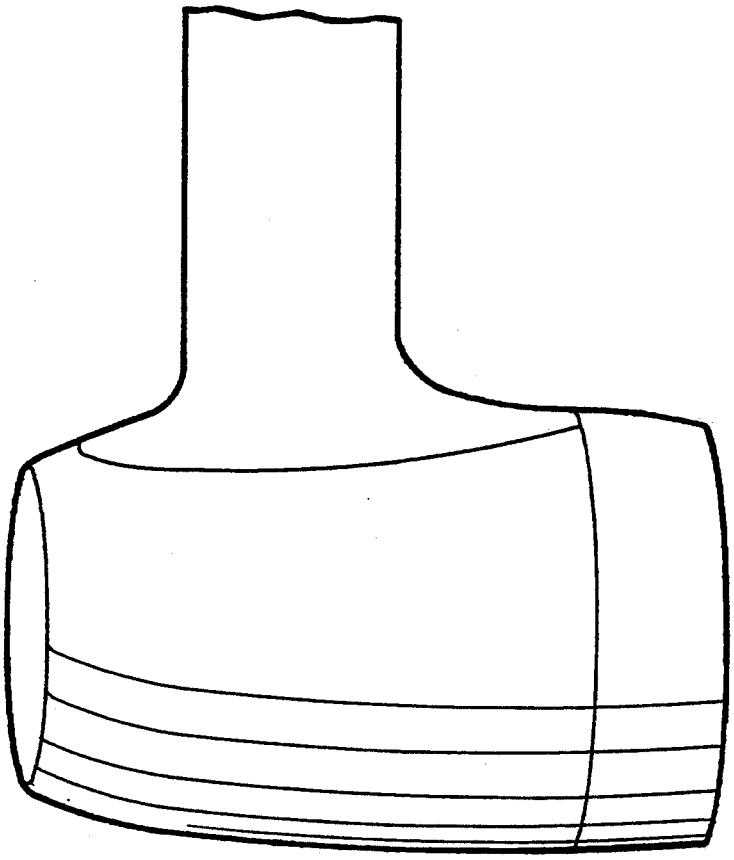

In driving the rotatable rotor, an embodiment as illustrated in the drawings can include gear teeth or slots 30 around the circumference of the rotor 5. These gear teeth or slots 30 engage with an endless belt drive mechanism 33 for rotatably driving the rotor 5 relative to the support member 1. When driven by the endless belt 33, the support member 1 may have openings for allowing passage of the belt to the rotor. It is recognized that the rotatable rotor of the present invention can be driven by any known means and the illustrated belt drive is only one example. For example, FIG. 9 is a schematic illustration of the rotor 5 having bevel type gears 80 circumferentially disposed around the rotor 5. The gears 80 cooperate with bevel type drive gears 85 of a driving device 90 for driving the rotor. The propulsion device of the present invention can be driven by any means such as electrical windings, gears, etc. and can be utilized as a pump, boat drive, spray unit, etc. FIG. 9 illustrates an example of the propulsion system of the present invention utilized in an outboard motor arrangement. The propulsion system of the present invention can operate in waters that tend to damage unprotected screw-type propulsion systems and in crafts such as mine-hunters that would benefit from a propulsion system that has a directional thrust that can be rotated around its vertical axis to provide maneuvering thrust.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A propulsion system comprising:

a cylindrical support member and a tubular rotatable member rotatably mounted within said support member and being adapted to permit a fluid flow therethrough, said tubular member defining first, second and third sections extending along a longitudinal direction of said tubular member, said first section of said tubular member slightly tapering inwardly in a direction toward a rotational axis of said tubular member for restricting said fluid flow therethrough, said second section extending radially outwardly in a direction away from said rotational axis, and said third section extending in a direction which is substantially parallel to the rotational axis; and vane means attached on an interior surface of said tubular member and comprising blades which extend in a direction toward said rotational axis such that rotation of said tubular member and the vane means attached thereon draws air/gas and fluid into the tubular member to accelerate the fluid flow through the tubular member;

wherein:

said blades of said vane means define first, second and third blade sections which extend along the longitudinal direction of said tubular member;

said first blade section is located at said first section of said tubular member and extends from an entrance of said tubular member to the second section of the tubular member for driving air/gas and fluid to said second blade section, said second blade section overlaps the first and third blade sections, and said second blade section extends from said first section to said third section of said tubular member, said third blade section extends from said second section to said third section of said tubular member and extends substantially to an exit of said tubular member; and said second and third blade sections guide the fluid received rom the first blade section through the tubular member, apply a centrifugal force to the fluid and draw in additional air/gas to the fluid.

2. A propulsion system according to claim 1, wherein said second and third blade sections are substantially hollow and comprise ducts for permitting air/gas introduction and increasing fluid acceleration.

3. A propulsion system according to claim 1, further comprising means for driving said tubular member relative to said support member

4. A propulsion system according to claim 3, wherein said drive means comprises gear means formed around a circumference of said tubular member which engages with an endless belt for rotatably driving said tubular member.

5. A propulsion system according to claim 1, wherein said second begins at a point along the tubular member where further restriction by the tapering first section would inhibit fluid flow.

6. A propulsion system comprising:

a cylindrical support member and a tubular rotatable member rotatably mounted within said support member and being adapted to premit a fluid flow therethrough, said tubular member defining first, second and third sections extending along a longitudinal direction of said tubular member, said first section of said tubular member slightly tapering inwardly in a direction toward a rotational axis of said tubular member for restricting said fluid flow therethrough, said second section extending radially outwardly in a direction away from said rotational axis, and said third section extending in a direction which is substantially parallel to the rotational axis; and vane means attached on an interior surface of said tubular member and comprising blades which extend in a direction toward said rotational axis such that rotation of said tubular member and the vane means attached thereon draws air/gas and fluid into the tubular member to accelerate the fluid flow through the tubular member;

wherein:

said blades of said vane means define first, second and third blade sections which extend along the longitudinal direction of said tubular member;

a first part of the first blade section is spaced from said interior surface of said tubular member so as to define a slot between said interior surface of said tubular member and said first part of the first blade section;

a surface of said first blade section comprises grooves which lead toward said rotational axis; and rotation of said tubular member and the vane means attached thereon draws air/gas and fluid into said slot and said grooves lead said air/gas and fluid from a high pressure area at said slot to a pressure area lower than said high pressure area at said rotational axis.

7. A propulsion system according to claim 6, wherein said second and third blade sections are substantially hollow and comprise ducts for permitting air/gas introduction and increasing fluid acceleration.

8. A propulsion system according to claim 6, further comprising means for driving said tubular member relative to said support member.

9. A propulsion system according to claim 8, wherein said drive means comprises gear means formed around a circumference of said tubular member which engages with an endless belt for rotatably driving said tubular member.

10. A propulsion system according to claim 6, wherein said second section begins at a point along the tubular member where further restriction by the tapering first section would inhibit fluid flow.

11. A propulsion system comprising:

a cylindrical support member and a tubular rotatable member rotatably mounted within said support member and being adapted to permit a fluid flow therethrough, said tubular member defining first, second and third sections extending along a longitudinal direction of said tubular member, said first section of said tubular member slightly tapering inwardly in a direction toward a rotational axis of said tubular member for restricting said fluid flow therethrough, said second section extending radially outwardly in a direction away from said rotational axis, and said third section extending in a direction which is substantially parallel to the rotational axis; and vane means attached on an interior surface of said tubular member and comprising blades which extend in a direction toward said rotational axis such that rotation of said tubular member and the vane means attached thereon draws air/gas and fluid into the tubular member to accelerate the fluid flow through the tubular member;

wherein:

said blades of said vane means define first, second and third blade sections which extend along the longitudinal direction of said tubular member; and an end portion of said second blade section and third blade section extends beyond said support member, said third blade section having a first lobe member which extends to a position substantially equal to an outside diameter of said support member and a second lobe member radially located between said rotational axis and said first lobe member.

12. A propulsion system according to claim 11, wherein said second and third blade sections are substantially hollow and comprise ducts for permitting air/gas introduction and increasing fluid acceleration.

13. A propulsion system according to claim 11, further comprising means for driving said tubular member relative to said support member.

14. A propulsion system according to claim 13, wherein said drive means comprises gear means formed around a circumference of said tubular member which engages with an endless belt for rotatably driving said tubular member.

15. A propulsion system according to claim 11, wherein said second section begins at a point along the tubular member where further restriction by the tapering first section would inhibit fluid flow.

* * * * *